US005333433A

United States Patent [19]

Porambo et al.

[11] Patent Number: 5,333,433

[45] Date of Patent: Aug. 2, 1994

[54] SELF-ADHESIVE WALLBOARD FINISHING TAPE AND TAPE-AND-WALLBOARD PANEL SYSTEM

[76] Inventors: Bernard A. Porambo, P.O. Box 14, West Baden Springs, Ind. 47469; Carolyn L. Usrey, 4331 Kinser Dr., Bloomington, Ind. 47408

[21] Appl. No.: 949,065

[22] Filed: Sep. 22, 1992

[51] Int. Cl.[5] ..... E04B 2/72; E04G 21/00

[52] U.S. Cl. ..... 52/417; 52/741.4; 52/747

[58] Field of Search ..... 52/344, 354, 416, 417, 52/254, 255, 288, 741.1, 741.4, 745.21, 747; 156/71, 574

[56] References Cited

U.S. PATENT DOCUMENTS

| | | | |
|---|---|---|---|
| T887,014 | 6/1971 | Overbay et al. | 52/417 |
| 1,312,056 | 8/1919 | Shaw . | |
| 1,691,179 | 11/1928 | Betz . | |
| 1,936,317 | 11/1933 | Walker et al. . | |
| 2,850,404 | 9/1958 | Dunlap | 52/417 |
| 3,180,058 | 4/1965 | Tillisch et al. | 52/417 |
| 3,289,370 | 12/1966 | Van Etten . | |
| 3,385,019 | 5/1968 | Frank | 52/417 |
| 3,408,250 | 10/1968 | Finefrock | 52/288 |
| 3,444,657 | 5/1969 | Swanson . | |
| 3,576,091 | 4/1971 | Shull, Jr. . | |
| 3,894,904 | 7/1975 | Cook . | |
| 4,151,245 | 4/1979 | Suzuki . | |
| 4,157,271 | 6/1979 | Moore . | |
| 4,220,490 | 9/1980 | Carlson . | |
| 4,230,753 | 10/1980 | Sheyon . | |
| 4,425,175 | 1/1984 | Moore . | |

*Primary Examiner*—Michael Safavi

*Attorney, Agent, or Firm*—Willian Brinks Hofer Gilson & Lione

[57] ABSTRACT

A self-adhesive tape is presented for concealing or "finishing" joints between adjacent wallboard panels in the construction of simulated monolithic wall surfaces. The finishing tape comprises an elongate substrate having opposing first and second surfaces and terminating in opposing side edges, first and second layers of a cementitious first adhesive disposed on the first surface of the substrate adjacent each opposing side edge of the substrate and a pressure-sensitive second adhesive disposed on the first surface of the substrate generally along a central portion of the substrate. When pressed over a joint formed by abutting edges of adjacent wallboard panels, portions of the cementitious first adhesive are caused to flow from beneath each side edge of the substrate to occupy recessed areas adjacent each opposing side edge of the substrate, and the pressure-sensitive second adhesive occupies an area between the substrate and the wallboard panel surfaces and bonds the substrate and the adjacent wallboard panels to form a substantially rigid structure, whereby the substrate forms over the joint a flush continuous surface with the adjacent wallboard panel surfaces.

16 Claims, 3 Drawing Sheets

SELF-ADHESIVE WALLBOARD FINISHING TAPE AND TAPE-AND-WALLBOARD PANEL SYSTEM

FIELD OF THE INVENTION

This invention relates to substrates for concealing or finishing joints between adjacent wallboard panels forming a simulated monolithic wall surface, and more particularly relates to a self-adhesive finishing tape provided with pre-applied adhesives that eliminate the need for a finishing layer of a drywall cementitious compound to be applied over the taped joint.

BACKGROUND OF THE INVENTION

Wallboard or "drywall" panels are widely used in the building of relatively inexpensive and durable walls. The panels are normally manufactured in dimensions of 4'×8', 4'×9', 4'×10', 4'×12' and typically ⅜" or ½" in thickness, and are nailed or otherwise adhered to wooden or metal studs or concrete blocks which form a vertical support for the wall. Conventional drywall construction methods commonly involve applying a plurality of these wallboard panels to such a vertical support thus forming joints between the adjacent wallboard panels. While the wallboard panels themselves can be quickly nailed or otherwise fixed in place to form the wall, the joint between the individual panels normally must be concealed or "finished" before the wall can be painted or covered. "Finishing" refers to the task of providing a smooth, continuous finish to the joint area that is flush with the adjacent wallboard panels that need only be sanded lightly prior to painting or covering.

One commonly used form of wallboard panel is gypsum drywall that comprises a generally rectangular panel, the front surface of which has a substantially flat central or face surface and tapered marginal surfaces extending circumferentially about the edge of the panel. The tapered marginal surface typically starts at a distance of from about 2½ to 3 inches from the panel edge and slopes downwardly to a maximum depth of from about 0.050 to about 0.070 inch. When the wallboard panels are erected in edgewise abutting relationship, the abutting edges of the adjacent panels collectively define a shallow V-shaped recessed area which extends along on both sides of the joint. This recessed area is commonly referred to as the "taper area".

A common method of finishing or concealing such joints comprises adhering over the joint a relatively narrow strip of paper, commonly referred to as "joint tape" by means of an aqueous gypsum cementitious adhesive, commonly referred to as "drywall mud". The width of the joint tape is typically slightly narrower than the dimension of the recessed area in the plane of the face surfaces of the wallboard panels. After the cementitious adhesive has been allowed to dry for about one day, another thin layer of the cementitious adhesive is applied over the taped joint, so that the intermediate product is a layer of cementitious adhesive being somewhat wider than the paper tape and tapered out to very thin edges. This second layer of adhesive is allowed to dry for about one day and then another thin layer of the cementitious adhesive, somewhat wider, is applied thereover. In this manner, a final substantially monolithic or flush wall surface appearance is provided and the complete surface may then be lightly sanded and subsequently covered with a decorative coating of paint or the like. This finishing operation is understandably quite time consuming and labor intensive. The particular joint finishing system used must have a smooth, substantially flat outer surface which is substantially level or coplanar with the face surfaces of the adjacent wallboard panels and somewhat wider than the taper area of the joint.

The joint tape provides reinforcing strength to the joint system and prevents cracking of the drywall mud adhesive applied over and along the joint. With this conventional technique for concealing or finishing drywall joints, there often develops a slight ridge or bead on the wall surface directly over the joint. This defect can mar the smooth appearance of the wall surface and costly repairs may be required to correct the condition.

As one can distill from the above discussion, this method of finishing joints requires a relatively long period of time due to the necessity of waiting about one day for each layer of adhesive to dry before the next layer can be applied. The drying times ensure that the job cannot be completed in less than 3–4 days. Sanding the dried mud plaster is both a tedious and unpleasant task and requires skill and patience as each of the three coats is usually required to dry at least 24 hours.

Oftentimes, as a worker is attempting to smooth and feather the mud compound on one panel surface near the joint line, an edge of his finishing tool inadvertently contacts the dry plaster compound previously applied and smoothed on the opposite panel surface, thereby leaving a blemish or mark in the plaster compound requiring the worker to go back and repair or "touch-up" that area, or causing small masses of the dry plaster compound to pull or break away from the dried plaster compound, such as in the form of chips or flakes, and mix with the wet plaster compound being applied to the opposite panel surface. The presence of the dry flakes in the wet plaster compound render providing a smooth finish thereto practically impossible. This can be a reoccurring nightmare for a worker as, while working on one panel surface, he must be sure not to contact the plaster compound applied to the opposing panel surface while still providing a continuous smooth surface between the taped area and the adjacent panel surface and along the junction line of the joint. This is a very labor-intensive process and persons skilled in the art readily appreciate the great amount skill required to achieve a smooth, continuous surface to the drywall compound applied to such joints.

Several prior attempts have been made to use various types of joint tape to cover the joint between adjacent wallboard panels. Examples of such attempts are U.S. Pat. Nos. 1,691,179; 1,936,317; 3,444,657; 3,576,091; 4,157,271; and 4,425,175.

U.S. Pat. No. 3,444,657 to Swanson describes a joint structure in which a molded plastic strip having a tapered cross-section fills the depressed tapered area along the joint. However, according to the system described in Swanson, the drywall panels must be of a special construction. The requirement for specially constructed wall panels limits the use of this type of strip to particular types of panels not generally available and, moreover, effectively precludes extensive commercial use of the system by individual construction companies and others.

U.S. Pat. No. 4,157,271 to Moore discloses a drywall joint filler including a flexible vinyl molded plastic strip with a central longitudinal spline intended to extend into the space between adjacent wallboard panels. The spline is equipped with spurs or whiskers to help secure the strip in place. The thickness of the strip decreases along its width to occupy the tapered depression area formed by the abutting wallboard panels. The strip is attached to the wallboard panels by double coated adhesive tape placed on opposite sides of the joint. In use, protective release paper is removed from the double-coated tape and the plastic strip is placed using the spline to locate the space between the wallboard panels and the strip is then pressed into place.

There remains a need, however, for an effective self-adhesive drywall finishing tape to maximize the economy and efficiency of wallboard finishing operations.

SUMMARY OF THE INVENTION

This invention presents a self-adhesive wallboard finishing tape that is intended for use to seal the seam or joint between adjacent wallboard (drywall) panels. The tape provided by this invention comprises a substrate having opposing first and second surfaces and terminating in opposing side edges, a first adhesive disposed on the first surface of the substrate adjacent each of the side edges of the substrate, whereby a central portion of the substrate is free of the first adhesive, and a second adhesive disposed on the central portion of the first surface of the substrate.

As noted above, conventional wallboard panels are manufactured with tapered edges to accommodate any variety of joint-concealing systems applied to the joint to provide a smooth, continuous surface between the adjoining panels. Joint tape, the presently preferred joint finishing system, is slightly narrower than the recessed tapered area at the joint, and when the joint tape is applied over a joint, as best seen in FIG. 2 of the drawings, there are areas "a" along side each side edge of the tape defined by the beginning point "P" of the tapered surface 42 and the side edge 10D of the tape. When the tape of this invention is pressed or rolled against the joint, the first adhesive preferably defined by a drywall mud adhesive pre-applied adjacent the side edges of the tape, "squeezes" out from beneath the edges of the tape to occupy these areas "a". The second adhesive, preferably defined by a pressure-sensitive construction adhesive pre-applied to the central portion of the first surface of the tape, occupies the area between the tape and the tapered surfaces of the wallboard panels, shown as area "b" in FIG. 2.

The finishing tape provided by this invention can be applied to different types of corner and straight joints found in conventional construction methods. If desired, the tape may also be formed with a central spline along its central longitudinal axis to assist the worker in applying the tape so that it is properly aligned along the joint.

The invention is illustrated and described in more detail by the drawings and the detailed description of a preferred embodiment that follows.

DETAILED DESCRIPTION OF THE PREFERRED EMBODIMENT

Figure 1:
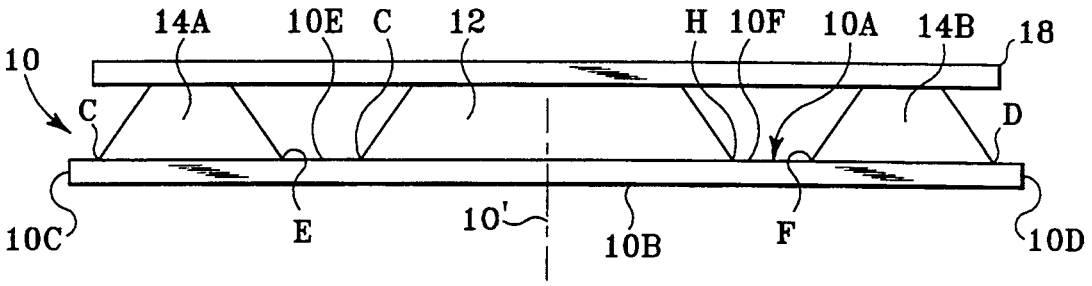
FIG. 1 is a section view of the finishing tape presented by this invention shown in an unapplied state.
Figure 2:
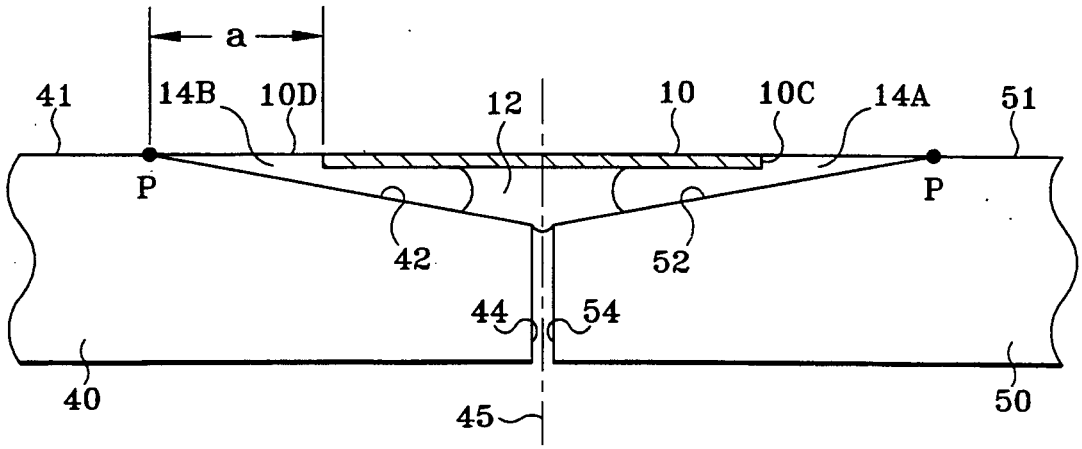
FIG. 2 is a partial section view of the finishing tape of FIG. 1 shown applied to a straight joint between adjacent wallboard panels.

As shown by the enclosed drawings, particularly FIGS. 1 and 2, this invention comprises a self-adhesive wallboard finishing tape 10 intended for use to seal, conceal or finish the seams or joints between adjacent wallboard drywall panels 40, 50. More particularly, the novel finishing tape 10 comprises an elongate paper substrate or strip 10 having opposing first and second surfaces 10A and 10B and terminating in opposing first and second side edges 10C and 10D, first and second layers 14A and 14B, respectively, of a first adhesive 14 carried on the first surface 10A of strip 10 and a layer of a second adhesive 12 also carried on the first surface 10A. The first layer 14A of the first adhesive 14 extends substantially continuously adjacent the first side edge 10C of the strip 10 and extends partially inwardly toward a central longitudinal axis 10' of the strip. The second layer 14B of the first adhesive 14 extends substantially continuously adjacent the opposing second side edge 10D of the strip 10 and extends partially inwardly toward the central longitudinal axis 10'. The layer of the second adhesive 12 lies between the first and second layers 14A, 14B of the first adhesive 14 on the first surface 10A. In use, the first surface 10A of strip 10 is intended to face the wallboard surfaces in use and the second surface 10B is intended to face away from the wallboard surfaces.

As noted above, conventional construction methods require a worker, after a wallboard joint has been taped with conventional joint tape, to apply drywall mud over the tape and the junction line of the joint (the junction line being the boundary between the two panels as depicted by reference line 45 in FIG. 2), and along one outer edge of the tape, smooth the mud compound over the edge of the tape and along one side of the junction line of the joint until a continuous smooth surface is achieved between the taped area and the adjacent panel surface, and then apply mud compound to the opposite panel surface adjacent the junction line and repeat the smoothing and finishing process for the opposite outer edge of the tape.

Figure 3:
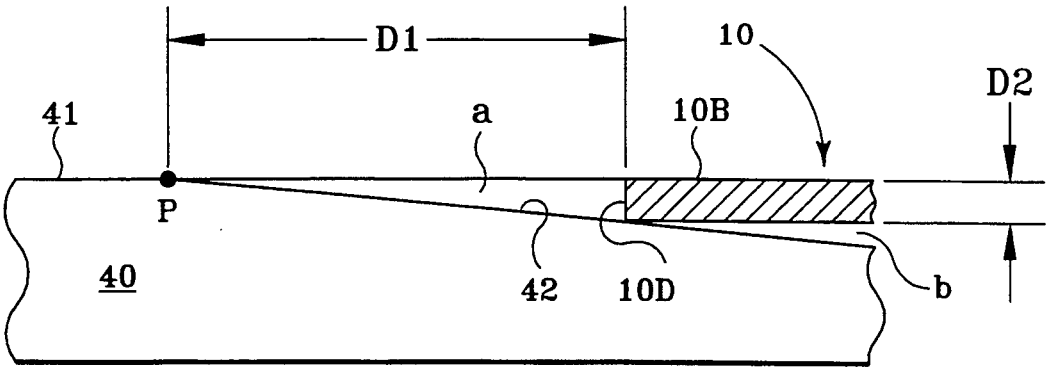
FIG. 3 is an enlarged partial section view of the taped joint of FIG. 2.

Referring now to FIGS. 2 and 3, wallboard tape 10 is intended to be applied to the joint between adjacent conventional wallboard panels 40 and 50. For reference purposes, the joint between panels 40 and 50 includes a junction line 45. Each such panel 40, 50 respectively has outer face surfaces 41, 51, tapered margin surfaces 42, 52, and edges 44, 54 that are perpendicular to face surfaces 41, 51. As noted, wallboard panels 40, 50 are typically manufactured with tapered margin surfaces 42 and 52, respectively, to accommodate the tape and drywall compound applied to the joint in conventional joint-concealing systems. Such panels are commonly positioned in such an arrangement so that their edges 44, 54 abut each other. When the panels are arranged adjacent one another in an edge-abutting relationship, face surfaces 41 and 51 are in a coplanar relationship to each other. Tapered surfaces 42 and 52 normally begin at a point (indicated as reference point "P" in FIGS. 2–5) about 2½ to 3 inches from the panel edges 44, 54, respectively, and slope downwardly to a maximum depth of about 0.050 to about 0.070 inches from the plane of the face surfaces 41, 51 of the panels.

As can be seen from FIG. 2, when the tape 10 is pressed or rolled against the joint, the first adhesive 14 pre-applied to the underside of the tape adjacent the side edges 10C, 10D "squeezes" out from beneath the side edges to occupy areas "a" which are defined by the beginning point "P" of tapered surfaces 42, 52 and the outer edges 10C, 10D of the tape 10. (FIG. 3 shows an enlarged isolated section view of one area "a".) The second adhesive 12 pre-applied to the central portion of the first side 10A of the tape 10 occupies the area "b" shown in FIG. 2, which is defined as the area between the first surface 10A of tape 10 and the tapered surfaces 42, 52.

In this invention, drywall mud adhesive is not pre-applied to the joint, as in conventional systems, to provide a bedding to adhere the tape to the joint; instead, the pressure-sensitive adhesive 12, in cooperation with the layers 14A and 14B of the first adhesive, bond the strip 10 and the adjacent wallboard panels 40, 50 in a substantially permanent fixed relationship that is not subject to displacement.

The substrate strip 10 is constructed preferably of paper but can be of any suitable material such as fiberglass, woven material, plastic, and other similar materials. When paper is utilized, the strength of the paper may be increased by the addition of a strength-enhancing material such as plastic or fiberglass. The wallboard joint tape 10 preferably has a width of approximately 3.75 inches (95.25 mm) to about 4.00 inches (101.6 mm), and a thickness D2 (FIG. 3) of about 0.075 inches (1.9 mm) to about 0.015 inches (3.8 mm).

The first adhesive 14 is preferably defined by an aqueous gypsum cementitous compound and second adhesive 12 is preferably defined by a self-adhesive pressure-sensitive construction adhesive. An adhesive 12 suitable for use with this invention is a pressure-sensitive hydrocarbon resin with clay and calcium carbonate such as one available from National Gypsum Company, Buffalo, N.Y., under the trademark LIQUID NAILS®.

The first and second layers 14A and 14B of adhesive 14 are disposed on the first surface 10A of the substrate 10 beginning at points "C" and "D", respectively, adjacent side edges 10C and 10D, respectively, and extend inwardly from the side edges toward central axis 10' to points "E" and "F", respectively, which are about 0.75 inches (19 mm) from the outer edges 10C, 10D of the substrate. The second adhesive 12 is disposed in a central portion of the first surface 10A of the substrate 10 beginning from a point "G" about 0.80 inches (20 mm) inward from the side edge 10C to a point "H" about 0.80 inches (20 mm) inward from the opposing side edge 10D of the substrate 10, whereby portions 10E and 10F of the first surface 10A between the first adhesive layers 14A and 14B and the second adhesive 12 are free of adhesives. Spacing the layers 14A and 14B of the first adhesive 14 slightly apart from the second adhesive 12 prevents each adhesive from combining and bleeding over into the other when applied to a joint under pressure. The layers 14A, 14B of the first adhesive 14 range in thickness from about 0.25 inches (6.4 mm) to about 0.35 inches (8.9 mm), and the second adhesive 12 ranges in thickness from 0.25 inches (6.4 mm) to about 0.35 inches (8.9 mm).

In use, when the strip 10 is applied to a joint under pressure, portions of the first layer 14A and of the second layer 14B of adhesive 14, particularly those portions immediately adjacent each side edge, have the ability to flow outwardly from beneath each side edge 10C, 10D to, in cooperation with the strip 10, occupy the taper area of the joint. The pressure-sensitive second adhesive 12 has the ability to bond the strip 10 and the adjacent wallboard panels 40, 50 in a fixed relation, whereby the second surface 10B of the strip 20 is substantially flush with the face surfaces 41, 51 of the wallboard panels 40, 50, respectively. Thus, application of the tape 10 can provide a flush wall surface over the joint which can then be covered or painted as desired once it is allowed to dry.

Referring particularly to FIG. 3, the width of the strip 10 is slightly narrower than the dimension of the taper area along the joint taken on the plane of face surfaces 41, 51, of panels 40, 50, respectively. As a result, area "a" is defined by the side edge 10D of strip 10 and reference point "P" where face surface 41 meets tapered surface 42, and has a linear dimension D1 of about 0.75 inches and a cross-sectional area of about 0.0014 square inches.

Figure 4C:
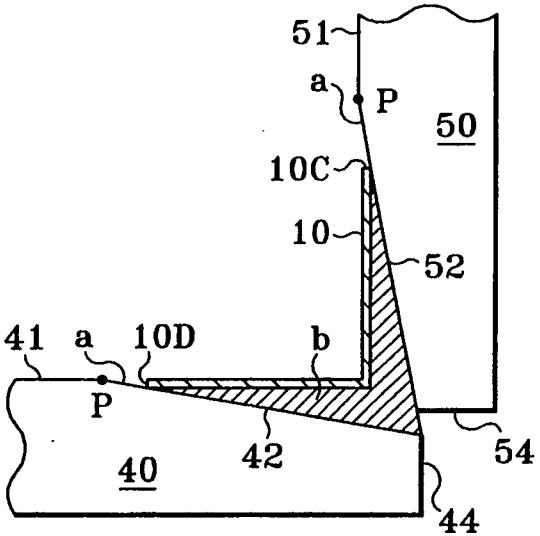
FIGS. 4A–4D present section views of the various types of corner and straight joints to which the finishing tape of this invention may be applied.
Figure 4B:
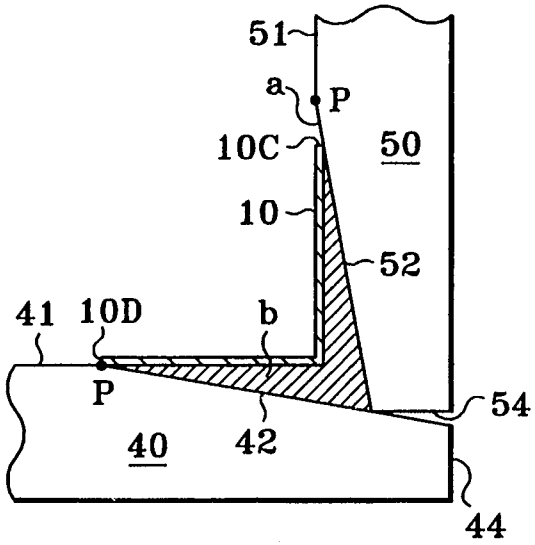
Figure 4A:
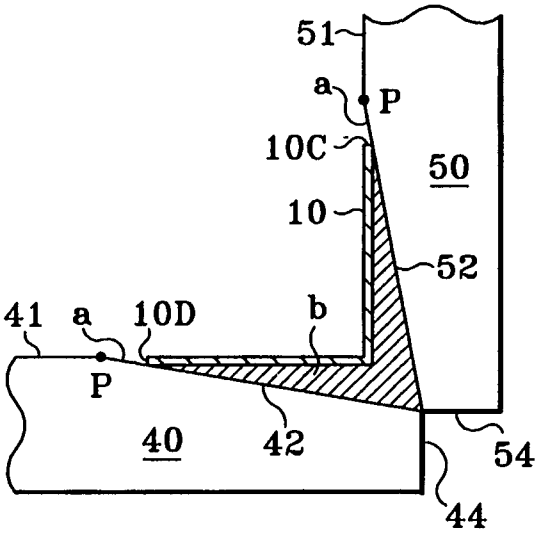

Illustrated in FIGS. 4A–4D are some of the various formations of corner and straight joints commonly found in conventional construction methods where the wallboard tape of this invention can be utilized. In each view, the tape 10 has been applied to cover the joint between the wallboard panels 40, 50 adjacent the respective tapered surfaces 42, 52 and edges 44, 54. First adhesive 14 pre-applied adjacent the edges of tape 10 feathers out to occupy the areas "a" on the opposing sides of the joint, while the area "b" between the tape 10 and the tapered surfaces 42, 52 is occupied by the second adhesive 12. More particularly, FIG. 4A shows panels 40 and 50 forming a corner joint in a 90° relationship with the inward portions of the panel edges 44, 54 disposed immediately adjacent each other. In such an arrangement, the tapered margin surfaces 42, 52 are substantially equal in dimension and, consequently, the corresponding areas "a" of panels 40 and 50 are also substantially equal once the tape 10 is positioned centrally over the joint. The first adhesive 14 pre-applied adjacent the side edges of the substrate strip 10 squeezes out from beneath each side edge 10C, 10D to fill and occupy these areas "a".

In FIG. 4B, panels 40 and 50 are arranged in a 90° corner relationship where panel 50 is arranged slightly up along tapered surface 42 of panel 40 resulting in the outer portion of edge 54 of panel 50 positioned immediately adjacent the inner portion of edge 44 of panel 40. In this arrangement, the area "a" on panel 40 has been mostly eliminated as indicated by side edge 10D of tape 10 being positioned very near reference point "P" while the area "a" on panel 50 is occupied by the first adhesive 14 bleeding out from beneath side edge 10C of strip 10. Because of the relative positioning of panels 40, 50 in FIG. 4B, area "a" on panel 50 may have a greater dimension than the corresponding area "a" on panel 50 as shown in FIG. 4A.

FIG. 4C shows panels 40 and 50 in another 90° corner relationship similar to that of FIG. 1 but with a slight gap between the inner portions of the panel edges 44, 54. In such an arrangement, strip 10 occupies the recessed area along the joint very similar to the arrangement of FIG. 1. While the corner arrangements in FIGS. 4A–4C are shown in a 90° relationship, other corner joints of varying angles can be constructed in accordance with this invention.

Figure 4D:
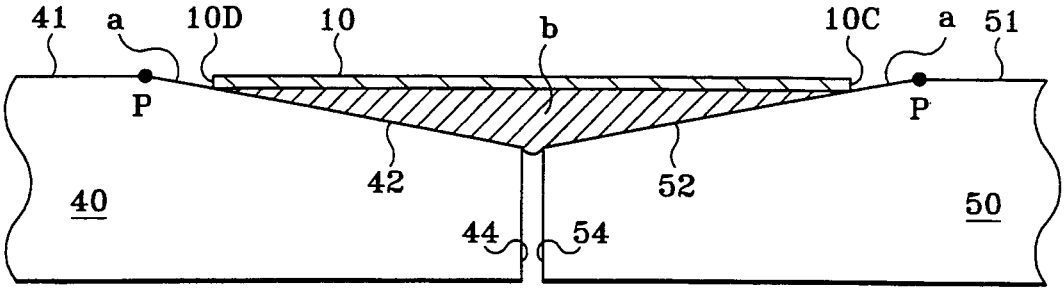

FIG. 4D shows panels 40, 50 in an adjacent flat relationship with a slight gap between the edges 44 and 54 of the panels. In this arrangement, the respective areas "a" on panels 40 and 50 are substantially equal and are filled and occupied by the adhesive 14 squeezing out from beneath the opposing side edges 10C, 10D. In each of the arrangements shown in FIGS. 4A–4D, the adhesive 12 satisfactorily occupies area "b" and supports and bonds the strip 10 and panels 40 and 50 in a substantially permanent relationship.

Figure 5:
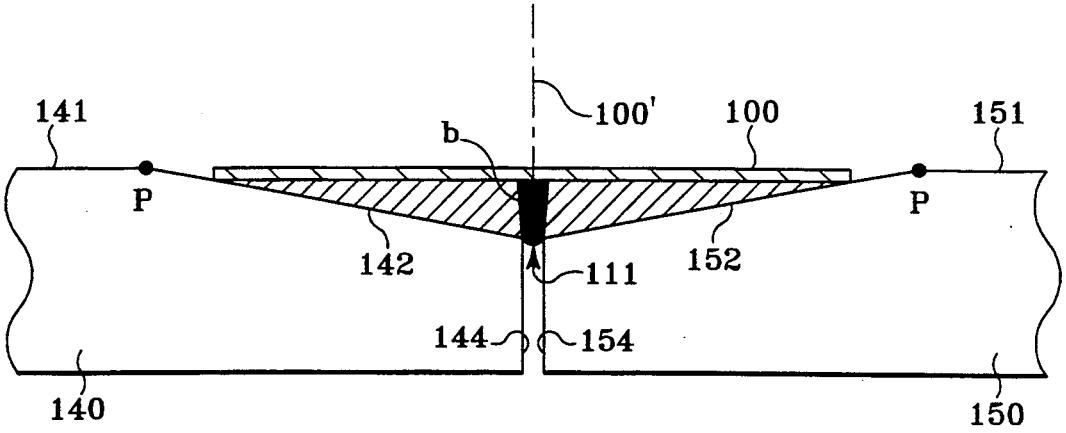
FIG. 5 presents a section view of a finishing tape provided by an alternative embodiment of this invention applied to a straight joint of adjacent wallboard panels.

In an alternative embodiment of this invention as shown in FIG. 5, tape 100 may be formed with a central bead or spline 111 arranged generally along the longitudinal central axis 100' of the tape 100 to assist a worker in aligning the tape in a joint such as that shown in FIG. 5 where a slight gap exists between the edges 144, 154 of panels 140, 150, respectively. In all other aspects, the strip 10 and its arrangement over the joint is substantially identical to that as shown in FIG. 2. Spline 111 can be constructed of a flexible or semi-flexible plastic material and permanently affixed to the underside surface 110A of strip 110 by conventional adhesives. If desired, central bead 111 may be equipped with whiskers or spurs to assist in securing the spline in the gap between the panel edges 144, 154.

A simulated monolithic building structure is also provided by this invention comprising at least two wallboard panels 40, 50 erected in substantially edge-abutting relationship forming a joint therebetween, which is sealed by the elongate joint-reinforcing substrate strip 10 provided by this invention.

In regard to the manufacturing and packaging of the finishing tape provided by this invention, the tape can be produced and shipped in large coils having, if desired, the pre-applied adhesives 12 and 14 protected and maintained in an operative condition (somewhat moist) by conventionally treated release paper 18 (FIG. 1) covering the first surface 10A of the tape, thereby allowing individual segments of the tape to be unwound from the coil and fitted and cut in varying lengths as needed. Release paper 18 can be very thin to facilitate the unspooling of the strip 10 when in roll form and the peeling of the paper from the substrate strip 10. It can be appreciated that the finishing tape has to be packaged properly so that the adhesives 12 and 14 pre-applied to the first surface 10A of the tape do not dry out and become flaky. With this in mind, the peel-off backing 18 may be useful, and sealed packaging may be utilized to prevent the small amounts of drywall mud and adhesive applied to the reverse side of the finishing tape from drying out.

This invention also provides a novel method of concealing the joints formed between adjacent wallboard panels 40, 50 in the construction of simulated monolithic wall surfaces where each of the panels 40, 50 has a tapered surface 42, 52, respectively, adjacent its edge adjacent the opposing panel so that the tapered areas collectively define a shallow V-shaped recessed area at the joint between the adjacent panels. The inventive method generally comprises the steps of:

a. providing an elongate strip 10, preferably a paper substrate, having first and second surfaces 10A and 10B and terminating in opposing side edges 10C and 10D, a first layer 14A of a first adhesive 14, preferably an aqueous gypsum adhesive, carried on the first surface 10A of the strip 10 and extending substantially continuously adjacent first side edge 10C of the strip and extending partially inwardly toward central longitudinal axis 10' of the strip 10, a second layer 14B of the first adhesive 14 carried on the first surface 10A of the strip and extending substantially continuously adjacent the opposing second side edge 10D of the strip and extending partially toward the central longitudinal axis 10', and a layer of pressure-sensitive second adhesive 12 carried on the first surface 10A generally along a central portion thereof;

b. aligning the strip 10 along and over the joint; and c. pressing the strip 10 over the joint by applying pressure to the second surface 10B of the strip and simultaneously causing a portion of at least one of the first and second layers 14A, 14B of the first adhesive 14 to flow outwardly from beneath the strip to occupy at least one of the recessed areas "a" of the wallboard joint adjacent a side edge of strip 10, and the pressure-sensitive second adhesive 12, which occupies the area "b" between the tapered wallboard surfaces 42, 52 and the strip 10, to bond the strip and the adjacent wallboard panels in a substantially fixed relation.

As a result of this inventive method, the strip 10 and the adhesive 12 and 14, when dried, occupy the recessed or tapered portion of the wallboard panel joint and form over the joint a flush surface coplanar with the face surfaces of the adjacent wallboard panels.

Thus, the invention provides the method and finishing tape as disclosed above in connection with the preferred embodiments as shown in FIGS. 1–5. It must be understood, however, that there are other embodiments and variations of the invention which may be developed and that the invention is not limited to the preferred embodiment and best mode of operation currently understood, but is only to be limited by the scope of the following claims.

I claim:

1. A wallboard assembly comprising:

at least two wallboard panels disposed adjacent one another, each said wallboard panel having a face surface and a tapered margin surface adjacent its edge adjacent the opposing wallboard panel so that the tapered margin surfaces of the adjacent wallboard panels collectively define a shallow V-shaped recessed area along the joint between said wall board panels;

a substrate having opposing first and second surfaces and terminating in opposing side edges and having a central portion disposed between said opposing side edges, said substrate having a width slightly narrower than the dimension of the recessed area in the plane of the face surfaces of the wallboard panels;

a first layer of a first adhesive disposed on the first surface of the substrate adjacent at least one said side edge, said first adhesive comprising an aqueous gypsum compound;

a second layer of said first adhesive disposed on the first surface of the substrate adjacent the opposite said side edge; and a second adhesive disposed along the central portion of the first surface of said substrate between the first and second layers of said first adhesive, said substrate applied to the joint between said adjacent wallboard panels with a portion of said first layer of said first adhesive extending out from beneath said first side edge to occupy an area between said first side edge of the substrate and an intersection point of the face surface and the tapered margin surface on the adjacent wallboard panel, and a portion of said second layer of said first adhesive extending out from beneath said second side edge to occupy an area between said second side edge and an intersection point of the face surface and the tapered margin surface on the adjacent wallboard panel, and the second adhesive disposed on the central portion of the first surface of said substrate occupies an area between the substrate and the tapered margin surfaces of each said wallboard panels, thereby bonding the tape and the wallboard panels in a substantially permanent fixed relationship.

2. A wallboard joint tape comprising:

a substrate having opposing first and second surfaces and terminating in opposing side edges and having a central portion disposed between said opposing side edges;

a first layer of a first adhesive disposed on the first surface of the substrate adjacent at least one said side edge, said first adhesive comprising an aqueous gypsum compound;

a second layer of said first adhesive disposed on the first surface of the substrate adjacent the opposite said side edge; and a second adhesive disposed along the central portion of the first surface of said substrate between the first and second layers of said first adhesive.

3. The wallboard joint tape as in claim 2 wherein the substrate is defined by an elongate strip of paper tape.

4. The wallboard joint tape as in claim 3 wherein the paper tape has a width of approximately 3.75 inches (95.25 mm) to about 4.00 inches (101.6 mm), and a thickness of about 0.075 inches (1.9 mm) to about 0.015 inches (3.8 mm).

5. The wallboard joint tape as in claim 2 wherein the first layer of said first adhesive is disposed on the first surface of the substrate beginning adjacent the first side edge thereof and extending inwardly to a point about 0.75 inches (19 mm) from said first side edge, and the second layer of the first adhesive is disposed on the first surface of the substrate beginning adjacent the second side edge thereof and extending inwardly to a point about 0.75 inches (19 mm) from said second side edge.

6. The wallboard joint tape as in claim 2 wherein the second adhesive is disposed in the central portion of the first surface of said substrate beginning from a point about 0.80 inches (20 mm) inward from the first side edge of said substrate to a point about 0.80 inches (20 mm) inward from the opposing second side edge of said substrate.

7. The wallboard joint tape as in claim 2 wherein the first and second layers of the first adhesive are disposed on the first surface of the substrate beginning adjacent the first and second side edges, respectively, and extend inwardly toward a central longitudinal axis of the substrate to a point about 0.75 inches (19 mm) from said first and second side edges of the substrate, and wherein the second adhesive is disposed on the central portion of the first surface of the substrate beginning from a point about 0.80 inches (20 mm) inward from the first side edge of the substrate to a point about 0.80 inches (20 mm) inward from the opposing second side edge of the substrate, whereby portions of the first surface of the substrate between the first and second layers of the first adhesive and the second adhesive are free of both said adhesives.

8. The wallboard joint tape as in claim 2 wherein the first and second layers of said first adhesive ranges in thickness from about 0.25 inches (6.4 mm) to about 0.35 inches (8.9 mm), and wherein the second adhesive agent ranges in thickness from about 0.25 inches (6.4 mm) to about 0.35 inches (8.9 mm).

9. The wallboard joint tape as in claim 2 further comprising a release liner placed over the first and second adhesives and the first surface of said substrate.

10. The wallboard joint tape as in claim 2 wherein the second adhesive is defined by a pressure-sensitive hydrocarbon resin with clay and calcium carbonate.

11. A self-adhesive joint-concealing tape and wallboard panel system, said system comprising:

at least two wallboard panels disposed adjacent each other, each said wallboard panel having a face surface and a tapered surface adjacent its edge adjacent the opposing panel so that the tapered areas collectively define a shallow V-shaped recessed area along the joint between said panels;

an elongate paper substrate having opposing first and second surfaces, said substrate terminating in opposing first and second side edges and having a width slightly narrower than the dimension of the recessed area taken on the plane of the face surfaces of the adjacent wallboard panels;

a first layer of an aqueous gypsum adhesive carried on the first surface of said substrate and extending substantially continuously adjacent the first side edge of said substrate and extending partially inwardly from a point adjacent said first side edge toward a central longitudinal axis of said substrate;

a second layer of aqueous gypsum adhesive carried on the first surface of said substrate and extending substantially continuously adjacent the opposing second side edge of said substrate and extending partially inwardly from a point adjacent said second side edge toward the central longitudinal axis of said substrate; and a layer of pressure-sensitive adhesive carried on the first surface of said strip between the first and second layers of said aqueous gypsum adhesive, wherein portions of said first and second layers of the gypsum aqueous adhesive have the ability, when the substrate is pressed over the wallboard joint, to flow outwardly from beneath each said side edge of the substrate to occupy the recessed area of the joint, and wherein the pressure-sensitive adhesive has the ability to bond the substrate and the adjacent wallboard panels in a fixed relation so that the second surface of the substrate is flush with the face surfaces of the adjacent wallboard panels to provide a continuous, substantially monolithic surface over the joint.

12. The self-adhesive wallboard tape as in claim 11 wherein the substrate is provided with a central spline extending generally along the central longitudinal axis thereof and outwardly from said first surface, said spline being adapted to, when the substrate is applied over a joint, extend into and occupy the space between the abutting edges of the adjacent wallboard panels.

13. The self-adhesive wallboard tape as in claim 11 wherein the wallboard panels are disposed at an angle to each other, and wherein the substrate is adapted to be formed to provide an interior wallboard corner flush with the adjacent wallboard panels.

14. The self-adhesive wallboard tape as in claim 11 wherein the aqueous gypsum adhesive comprises a major amount of inorganic filler material, a minor amount of binder material and a quantity of water sufficient to form a pastelike mixture of workable consistency.

15. A simulated monolithic building structure comprising at least two wallboard panels erected in a substantially edge-abutting relationship forming a joint therebetween, each said panel having an outer face surface arranged in substantially coplanar relationship with each other and an abutting edge surface which is substantially perpendicular to the outer face surface with at least the portion of the abutting edge surfaces of said panels immediately adjacent the face surfaces thereof being adjoined throughout the extent of the joint by a elongate joint-reinforcing substrate adhered thereto, said substrate forming in cooperation with said panels a rigid unitary structure resistant to displacement, wherein said elongate joint-reinforcing substrate comprises:

a paper substrate having opposing first and second surfaces and terminating in opposing first and second side edges;

a first layer of aqueous gypsum cement carried on the first surface of said substrate and extending substantially continuously longitudinally adjacent the first side edge of the substrate and extending partially latitudinally from a point adjacent said first side edge toward a central longitudinal axis of said substrate;

a second layer of aqueous gypsum cement carried on the first surface of said substrate and extending substantially continuously longitudinally adjacent the opposing second side edge of the substrate and extending partially latitudinally from a point adjacent said second side edge toward the central longitudinal axis of said substrate; and a layer of pressure-sensitive adhesive carried on the first surface of said substrate between the first and second layers of said aqueous gypsum cement, wherein portions of said first and second layers of the gypsum aqueous adhesive cement have the ability, when the substrate is applied with pressure over the wallboard joint, to flow outwardly from beneath each said side edge of the substrate to, in cooperation with said substrate, occupy the recessed area of the joint, and wherein said pressure-sensitive adhesive has the ability to bond the substrate and the adjacent wallboard panels in a fixed relation so that the second surface of the substrate is flush with the face surfaces of the wallboard panels to provide a flush wall surface over the joint.

16. A method of concealing the joints formed between adjacent wallboard panels in the construction of a simulated monolithic wall surface, each said wallboard panel having an outer face surface, a circumferential edge disposed perpendicular to said face surface, and a tapered margin surface area adjacent said edge adjacent the opposing wallboard panel so that the tapered areas of the adjacent panels collectively define a shallow V-shaped recessed area at the joint between said wallboard panels, said method comprising the steps of:

a. providing an elongate strip having opposing first and second surfaces and terminating in opposing side edges, a first layer of a first adhesive defined by an aqueous adhesive carried on the first surface of said strip and extending substantially continuously adjacent a first side edge of the strip and extending partially inwardly from a point adjacent said first edge toward a central longitudinal axis of said strip, a second layer of said aqueous adhesive carried on the first surface of said strip and extending substantially continuously adjacent the opposing second side edge of said strip and extending partially inwardly from a point adjacent said second side edge toward the central longitudinal axis of said strip, and a layer of a second pressure-sensitive adhesive carried on the first surface of said strip generally along a central portion of second strip, said strip having width slightly narrower than the dimension of the recessed area at the plane of the face surfaces of the adjacent wallboard panels;

b. aligning said elongate strip along and over the joint between the adjacent wallboard panels; and c. pressing said elongate strip over the joint by applying pressure to the second surface of said strip and simultaneously causing a portion of the first layer of the first adhesive to flow outwardly from beneath the first side edge of said strip to occupy the recessed area of the wallboard joint adjacent the first side edge of said strip, causing a portion of said second layer of the first adhesive to flow outwardly from beneath the second side edge of said strip to occupy the recessed area of the wallboard joint adjacent the second side edge of said strip, and causing the pressure-sensitive adhesive to bond to an area between the tapered margin surfaces of the adjacent panels and the first surface of said strip in a substantially fixed relation, whereby the aqueous adhesive can form a substantially flush continuous surface between the second surface of said strip and the face surface of the adjacent wallboard panels.

* * * * *